United States Patent [19]

Sigmund

[11] 4,104,780

[45] Aug. 8, 1978

[54] METHOD AND SYSTEM FOR TIGHTENING JOINT ASSEMBLY

[75] Inventor: Jerry A. Sigmund, Willow Grove, Pa.

[73] Assignee: SPS Technologies, Inc., Jenkintown, Pa.

[21] Appl. No.: 755,410

[22] Filed: Dec. 29, 1976

[51] Int. Cl.[2] ..... B25B 23/14

[52] U.S. Cl. ..... 29/407; 73/88 F; 173/12

[58] Field of Search ..... 73/88 F, 139; 173/1, 173/12; 81/52.4 R, 52.4 B, 52.5; 29/240, 407

[56] References Cited

U.S. PATENT DOCUMENTS

| | | | |
|---|---|---|---|
| 3,745,820 | 7/1973 | Weiner | 73/139 |
| 4,026,369 | 5/1977 | Vliet | 81/52.4 B |

*Primary Examiner*—Charles A. Ruehl
*Attorney, Agent, or Firm*—Aaron Nerenberg

[57] ABSTRACT

The preferred embodiment of the invention disclosed herein relates to a method of and a tightening system for tightening a joint assembly including a fastener system to a yield point of one of the members in the assembly. According to the method torque is applied and rotation is imparted to a fastener member and the instantaneous slope of the Torque-Rotation curve which could be plotted is determined between successive increments of rotation of the fastener member. Each instantaneous slope is compared with the preceding instantaneous slope to determine the change in the slope of the curve. When the instantaneous slope of the curve decreases a predetermined consecutive number of times equal to a predetermined span of rotation divided by the interval between successive increments of rotation, tightening is discontinued. The tightening system includes a wrench and a control system associated with the wrench including gradient calculating means for determining the instantaneous slope between successive increments of rotation of the Torque-Rotation curve and for determining an instantaneous gradient signal representative thereof. Comparator means responsive to the instantaneous gradient signal determines the change in successive instantaneous gradient signals and develops signals indicating that the slope has increased or decreased. The indicating signals are fed to resettable counter means which counts each decrease signal, and resets to zero each time it receives an increase signal. When the counter means detects a predetermined successive number of decrease signals, it outputs a control signal that discontinues operation of the wrench.

18 Claims, 2 Drawing Figures

METHOD AND SYSTEM FOR TIGHTENING JOINT ASSEMBLY

Figure 2:
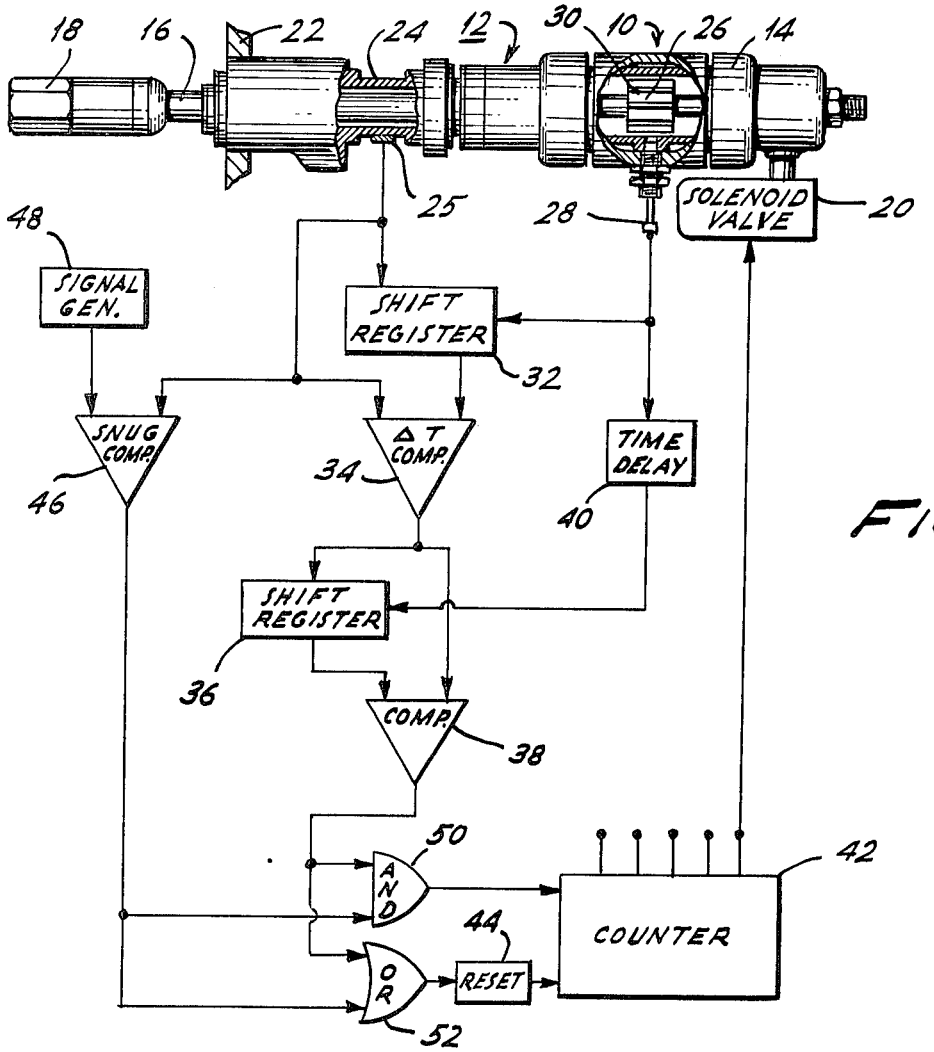

This invention relates generally to a method of and apparatus for tightening fasteners and, more particularly, to a method and apparatus of the type disclosed in the following United States Patents owned by the Assignee of this invention: Hardiman et al, U.S. Pat. No. 3,939,920; Aspers et al, U.S. Pat. No. 3,965,778; Smith, U.S. Pat. No. 3,973,434; Walker, U.S. Pat. No. 3,974,685; Sigmund, U.S. Pat. No. 3,974,883; and, Boys, U.S. Pat. No. 3,982,419.

In the design of structural joints secured by mechanical fastener systems, it is usual to provide for the fasteners to exert a predetermined clamping force or load on the structural members to insure the integrity of the joint. When the joints are assembled, therefore, it is desirable that the fasteners be tightened to exert a predetermined axial load on the associated structural members. However, most prior art tightening techniques for tightening threaded fasteners such as nuts and bolts to exert a predetermined load on associated structural members are not entirely satisfactory. For example, the most accurate tightening technique involves a measurement of the axial strain or stretch of the bolt while it is being tightened and relating the stretch to the stress or axial load acting on the bolt through previously calculated stress-strain relationships. While most accurate, practical applications do not usually permit measurement of the stretch of the bolt and, in those instances where the stretch can be measured, it is a time consuming and relatively expensive technique. Accordingly, this tecnhique is used in relatively few applications outside of laboratory testing.

In an attempt to overcome the problems associated with measuring the stretch of the bolt, a technique has been attempted that utilizes the fact that the stretch of the bolt, and thus the axial load is related to the angle through which the bolt has been rotated after the actual tightening of the joint has commenced. In practicing this technique it is usual to tighten the bolt to its snug point, that is, the point at which the structural members forming the joint assembly have been pulled together, the bearing surface of the bolt has engaged the face of the adjacent structural member and the bolt starts to exert a clamping force on these members. From the snug point the angular rotation of the bolt is measured and the tightening of the bolt is discontinued when the bolt has been rotated through a predetermined angle indicating that a predetermined axial load has been induced in the bolt and is, thus, exerted on the structural members. The usual technique for determining that the bolt has been tightened to its snug point involves the assumption that the snug point is reached when a predetermined torque is applied to the bolt and measuring the torque applied to the bolt as it is tightened. When the predetermined torque is applied to the bolt, the measurement of the angular rotation commences. However, torque measurement to determine the snug point is not very accurate and an error is introduced when the measurement of angular rotation commences. Accordingly, the torque-angular measurement technique is not very accurate.

Another known tightening technique and that most commonly used in most joint assembly operations involves the use of torque controlled tools, that is, tools that indicate when the torque applied to the fastener equals or exceeds a predetermined torque and stop tightening the fastener in response thereto. Torque measurement is relatively easy and since torque is related to the axial force induced in the fastener, and exerted on the structural members, the predetermined torque can be selected to theoretically correspond to the predetermined clamp load specified for the joint. However, when tightening threaded fasteners in assembly line operations, wide variations in the actual torque-load relationships are experienced. These variations are caused by a variety of factors including allowable tolerance variations in the dimensions and strength of the fasteners and structural members and lubrication or absence thereof on the mating surfaces of the fasteners and/or the structural members, all of which, in turn, cause large variations in the coefficient of friction between the mating surfaces of the joint. In actual practice, variations of up to $\pm$ 30% in the axial load on the bolts used for a particular application can be experienced at the same torque level. Accordingly, the torque control technique is not very accurate.

In an effort to overcome above-noted problems several techniques have been attempted that include the use of tools measuring both the torque and angular displacement or rotation of a fastener during the tightening cycle and which include control systems operative in responsive to these measurements to determine when the slope of a Torque-Rotation curve for the fastener indicates that the yield point of the fastener has been reached and to then stop tightening the fastener. Examples of techniques and tools of this type are disclosed in U.S. Pat. No. 3,643,501, issued Feb. 22, 1972 to Pauley and U.S. Pat. No. 3,693,726, issued Sept. 26, 1972 to Hornig et al. Neither the techniques nor the tools disclosed in the Pauley and the Hornig et al patents are generally satisfactory. In each of the disclosed techniques it is necessary to know the torque-rotation relationship for the particular fastener being tightened prior to its tightening. The torque-rotation relationship varies over a wide range for the same reasons that the torque-load relationships vary and, accordingly, the techniques and tools disclosed in the Pauley and Hornig et al patents can be utilized only where the characteristics of the joint assembly are known beforehand and average relationships must be predetermined and utilized in operation of the tools. Accordingly, the versatility and accuracy of the techniques and tools disclosed in the Pauley and Hornig et al patents are not particularly satisfactory.

It is an object of this invention, therefore, to provide a method and apparatus for tightening a fastener system to its yield point or similarly significant point corresponding to a predetermined axial load.

It is yet another object of this invention to provide a method and apparatus for tightening a fastener system to its yield point or similarly significant point on a Torque-Rotation curve which could be plotted for the fastener being tightened.

It is still another object of this invention to provide a method and apparatus for tightening a fastener system to a predetermined axial load with minimum previous knowledge of the particular joint being assembled.

Finally, it is an object of this invention to provide a tightening system that is versatile, reliable and accurate.

These and other objects of this invention are accomplished by applying torque and imparting rotation to a fastener member in a joint assembly and measuring first and second tightening characteristics simultaneous therewith; determining the instantaneous slope between predetermined increments of the second tightening characteristic of a curve which could be plotted for first and second tightening characteristics experienced by the fastener during the tightening cycle; and determining when the fastener has experienced a predetermined measure of the second characteristic after the maximum instantaneous slope has been determined. More particularly, the instantaneous slope of the curve is compared to the slope determined at the previous increment to detect the change in the slope between successive increments of the second characteristic and when the slope of the curve has continuously decreased over a predetermined number of successive increments, the tightening of the fastener is discontinued.

Preferably the first characteristic is the torque applied to the fastener and the second characteristic is the rotation of the fastener. The predetermined number of successive increments is equal to the predetermined measure of rotation divided by the interval between increments of rotation.

A tightening system in accordance with this invention includes wrench means for tightening a fastener in a joint assembly. Associated with the wrench means is first means for measuring a first tightening characteristic and developing a signal representative thereof and second means for measuring a second tightening characteristic and developing a signal representative thereof. Responsive to the first and second signals is gradient calculating means for determining the instantaneous slope between predetermined increments of the second tightening characteristic of a curve which could be plotted for the first and second characteristics and developing a signal representative thereof. Also provided is comparator means responsive to said instantaneous slope signals for determining the change between successive instantaneous slope signals and for developing signals indicating that the slope of the curve has increased or decreased. Finally, control means responsive to said indicating signals is provided for providing a control signal when the fastener has been tightened a predetermined measure of the second tightening characteristic from the increment of said second tightening characteristic at which the maximum slope of the curve has been experienced. More particularly, the control means provides the control signal when the slope of the curve has decreased continuously over the predetermined measure of the second tightening characteristic. Conveniently the control means is in the form of counter means which counts a predetermined number of successive signals indicating that the slope has decreased.

Preferably, the first tightening characteristic is the torque applied to the fastener and the second tightening characteristic is the rotational displacement of the fastener. Also, the control signal is utilized to operate a control valve which discontinues the operation of the wrench means.

Figure 1:
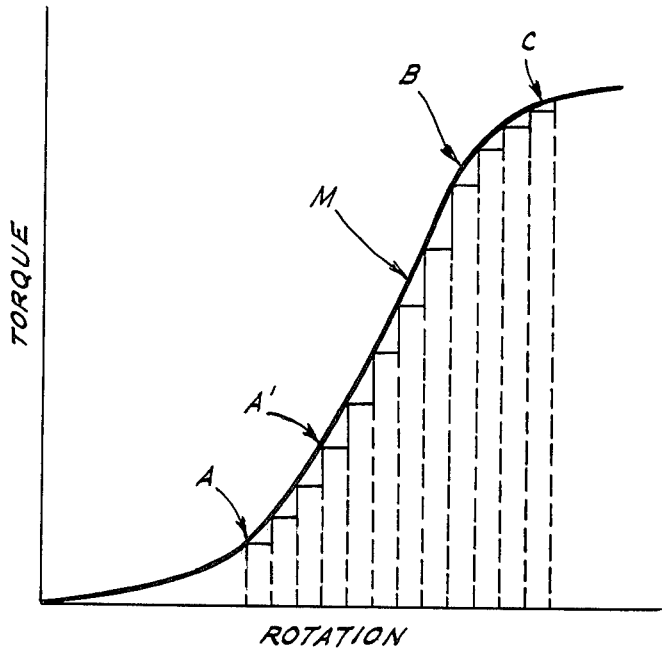

For a better understanding of the invention disclosed herein, reference is made to the following description of a preferred embodiment of the invention taken in conjunction with the figures of the accompanying drawing, in which:

FIG. 1 is a plot of a curve illustrating the characteristics of a typical torque-rotation relationship experienced by a fastener during the tightening cycle and graphically illustrating an underlying principle of the invention; and, FIG. 2 is a schematic drawing of a tightening system in accordance with this invention.

Referring to FIG. 1, there is illustrated a typical Torque-Rotation curve for a threaded fastener being tightened with the torque plotted along the vertical axis and with the angular displacement or rotation plotted along the horizontal axis. The curve includes an initial or pretightening region extending from the intersection of the torque and rotation axes to point A. In the pretightening region, mating threads of the fastener assembly have been engaged and one of the fasteners is being rotated, but the bearing face of the rotating fastener has not contacted the adjacent face of the structural member included in the joint. At point A on the curve the structural members have been pulled together by the fastener assembly and actual tightening of the joint commences. The torque at point A is commonly referred to as the "snug" torque. In the tightening region of the curve, extending from point A to point B, axial force is exerted by the fastener assembly clamping the joint members together. In the tightening region a typical curve may be slightly arcuate, but approximates linearity and includes a first segment wherein the slope of the curve is increasing slightly until it reaches a maximum illustrated at point M and further includes a second segment wherein the slope of the curve is decreasing slightly. As will be more fully explained hereinafter, a point A′ is selected which lies on the tightening region of the Torque-Rotation curve and is called a "turn-on" point in the tightening cycle. Point B is the limit of proportionality of the joint assembly and beyond point B the rotation of the fastener member starts increasing at a significantly faster rate than does the torque. If the curve is linear between points A and B it should be realized that point M will coincide with point B. For purposes of this application, point B will be considered as the start of the yield region, but it will be understood that beyond point B, additional axial load is still induced in the joint assembly but at a significantly non-linear rate of increase. Point C corresponds to the yield point of the joint assembly and while the definition of yield point varies slightly, it can be considered to be the point beyond which strain or stretch of the bolt is no longer purely elastic. As will become apparent, a tightening system in accordance with this invention is capable of detecting point C on the Torque-Rotation curve and responding thereto to generate a control signal.

While in the preceding paragraph reference has been made to the limit of proportionality and yield point of the joint assembly, it should be noted that because of the usual design criteria these terms usually apply to characteristics of the fastener assembly since fastener assemblies are not usually as rigid as the structural members forming the joint assembly and most usually apply to the male fastener member or bolt.

It should be understood that the invention relates to a method and apparatus which detects the yield point by utilizing torque and rotation input characteristics but which is also capable of detecting the yield point by utilizing other tightening characteristics related in a manner similar to torque and rotation. It should be further understood that particular joint assemblies could include fastener assemblies constructed such as to cause the curve being plotted to significantly deviate from linearity at a predetermined load other than the yield point. Such deviation could be detected in accordance with this invention and for this reason, as used hereinafter, the term yield point should be construed to include the yield point of the material from which the fastener is made as well as points on a flattened portion of a Torque-Rotation or similar curve generated by the configuration of the fastener at a predetermined clamping load.

Still referring to FIG. 1 there is shown a series of dotted lines extending upwardly from the rotation axis to the Torque-Rotation curve. The dotted lines are located at equally spaced increments of rotation along the axis and, of course, of the fastener and define between them predetermined equal intervals of rotation. As an underlying principle of this invention, it has been determined that from point M on the Torque-Rotation curve at which the maximum slope occurs, to point C, the yield point of the fastener, there is a generally consistent rotational displacement of the fastener. For example, in studying the Torque-Rotation curve for a 7/16th, Grade 8 fastener tightened in a relatively rigid joint, the rotational displacement from the point at which the maximum slope occurred to the yield point was about 28°. In the study of the Torque-Rotation curve for a 7/16th, Grade 5 fastener tightened in a joint including a gasket, that is a relatively soft joint, the rotational displacement of the fastener from the point at which the maximum slope occurred to the yield point was about 23°. It is believed that from the point at which the maximum slopes occur to the yield point on a Torque-Rotation curve there is a rotational displacement, depending on the particular fastener and joint assembly being tightened, of about 15° to 35°. The upper and lower limits of the preceding range are for rather extreme joint conditions, and it is believed that as a general rule, 25° is the most usual rotational displacement of a fastener from the point M on its Torque-Rotation curve to the point C. While the general rule is not exact it is sufficient to assure relatively accurate tightening of a fastener to the axial load at which the fastener material yields. The noted accuracy results from the fact that in the yield region of a Stress-Strain curve an error in rotational displacement does not significantly change the axial load on the fastener. That is to say that similar to the Torque-Rotation curve, the Stress-Rotation curve is such that in the yield region the stress or axial load does not vary significantly with rotational displacement of the fastener. Thus, by selecting a rotational displacement large enough to assure that the fastener has been tightened into the yield region, a relatively high degree of accuracy can be obtained in accordance with this invention.

In practicing a method in accordance with this invention torque is applied to a fastener in a joint assembly thereby imparting rotation to the fastener to tighten it and provide a clamping load for the joint assembly. While the fastener is thus tightened the torque applied to the fastener and its rotational displacement are measured and the instantaneous slope of the curve between predetermined increments of rotation for the Torque-Rotation curve of the fastener being tightened is determined. Conveniently the instantaneous slope can be calculated by measuring the torque at equal increments of rotation and by subtracting from the torque being applied at the instantaneous increment, the torque applied at the previous increment. By subtracting torque over equal increments of rotation the difference is proportional to the slope of the Torque-Rotation curve between the predetermined increments. After calculating the instantaneous slopes, a determination can be made by examining the slopes at which increment of rotation the maximum slope of the curve has been experienced. From the increment of rotation thus determined it is only necessary to measure the rotational displacement of the fastener until the fastener has been tightened through the predetermined rotational displacement noted previously, that is, a displacement in the range of about 15° to 35°, preferably 25°. When the fastener has been rotated through the predetermined rotational displacement from the determined increment, tightening of the fastener is discontinued and it should be clear that the fastener has been tightened to about its yield point.

A most convenient technique for accomplishing this invention is to utilize the fact that the slope of the curve decreases continuously from the point M. Thus, in a preferred method in accordance with this invention successive instantaneous slopes of the curve are compared to determine whether the slope has increased or decreased between successive increments of rotation. Each time the slope decreases, the decrease is counted until a predetermined successive number of decreases has been detected. The number of successive decreases is, of course, equal to the predetermined rotational displacement of the fastener from the point M to the yield point C on the Torque-Rotation curve divided by the interval of rotation between increments. Each time the slope of the curve is detected to be increasing the increase is, of course, not counted and the counting of decreases starts over from zero.

At this point it is noted that the Torque-Rotation curve can experience certain upward spikes resulting from burrs on the thread or bearing surface of the fastener or from chips of metal inadvertently dropped in a threaded hole. The curve can also experience certain downward spikes resulting from oil or other lubricant inadvertently placed on the fastener. Being the result of accident these spikes can occur anywhere on the curve. If the Torque-Rotation curve experiences a downward spike prior to the fastener being tightened to point M, the slope of the curve decreases temporarily, but quickly increases so that as soon as the increase is detected, the count of the decreases caused by the spike is discontinued. Accordingly, the accuracy of the method is not effected. If the Torque-Rotation curve experiences an upward spike after the fastener has been tightened to point M, the slope of the curve increases so that the counting of successive decreases is discontinued, but starts over as soon as the next decrease is detected which occurs rather quickly in the tightening cycle. Accordingly, the accuracy of the method is not seriously effected since, as noted previously, the axial load in the fastener does not vary significantly in the yield region.

While the above method may be practiced by utilizing a conventional torque wrench and any of the conventional angular displacement measuring devices currently available, in accordance with this invention, a tightening system automatically carrying out the method is disclosed.

Referring now to FIG. 2, there is illustrated a tightening system 10 in accordance with this invention. Tightening system 10 includes a wrench 12 having a motor 14, an output drive shaft 16 and a driver bit 18. Drive shaft 16 is driven by motor 14 to apply torque and impart rotation to a fastener member engaged by driver bit 18. Wrench 12 can be of any conventional type and as is most common, motor 14 can be air powered with the flow of motive air being controlled by a suitable electrically operated control valve 20. It should be understood that motor 14 could also be electric, hydraulic or any combination of pneumatic, hydraulic or electric. The exact details of the wrench are not necessary for a proper understanding of the invention and, accordingly, a more specific description is not provided.

Mounted between the housing of motor 14 and a rigid frame 22 on which the wrench is carried, is a suitable transducer or torque cell 24 for generating a continuous signal representative of the instantaneous torque being applied to the fastener. Torque cell 24 can be any of a variety of conventional devices and in the embodiment disclosed herein comprises a somewhat flexible annular member having strain gauges 25 secured to its outer periphery so that the reaction torque on the wrench is measured and an electrical signal is generated. The reaction torque is, of course, equal to and opposite the torque being applied to the fastener. Mounted on drive shaft 16 for rotation therewith and preferably within motor 14, is a suitable encoder 26 that cooperates with a proximity detector 28 for developing signals representative of the incremental angular displacement or rotation of the fastener. Encoder 26 is arranged to rotate with the driver bit 18 and can be any of the variety of suitable devices. In this embodiment the encoder 26 includes a series of teeth 30 formed on its outer periphery. Proximity detector 28 can be induction coil which develops an electrical signal when metal passes through its magnetic field and, thus, senses the passage of the encoder teeth and develops an electrical signal representative of predetermined increments of angular rotation. While examples of torque and rotation measuring devices have been described, it should be understood that any of a variety of devices for accomplishing the noted result can be utilized with the invention.

A control circuit is operatively associated with wrench 12 for controlling the tightening of the fastener and includes a gradient calculating system that determines the instantaneous gradient or slope of the Torque-Rotation curve which could be plotted for the particular fastener being tightened and develops an electrical signal representative thereof. The gradient calculating system comprises a shift register 32 to which the instantaneous torque signal is fed and whose output is clocked by the rotation signal at fixed increments of angular rotation. Shift register 32 is in the form of a single sample and hold circuit comprising a charge coupled device. Accordingly, the output of shift register 32 is a signal representative of torque the increment of rotation immediately preceding the instantaneous increment. A comparator 34 in the form of a differential amplifier or suitable subtraction circuit receives the output of shift register 32 and also receives the signal from the strain gauge 25 representative of instantaneous torque and provides an output signal representative of the difference. Since torque signals are subtracted over equal increments of rotation, the output signal from comparator 34 is representative of the instantaneous slope of the Torque-Rotation curve through which the fastener is being tightened.

The instantaneous gradient signal from the comparator 34 is fed to a second shift register 36 and also to a comparator 38 which receives another input from the second shift register. The shift register 36 is also in the form of a single sample and hold circuit comprising a charged couple device and its output is clocked by the rotation signal from the proximity probe 28 at fixed increments of angular rotation of the fastener, which signal is fed to the shift register through a suitable time-delay circuit 40. Use of the time-delay circuit 40 delays clocking the shift register 36 until the comparator 34 has provided an output. Thus, the comparator 38 receives no input from the shift register 36 until the comparator 34 discharges its instantaneous slope signal to the comparator 38. Since the shift register 36 is a single sample and hold circuit, its output to the comparator 38 is a signal representative of the slope of the curve at the increment of rotation immediately prior to the instantaneous increment. Thus, the comparator 38 compares the instantaneous slope signal with the slope signal representative of the slope at the previous increment of rotation and can detect whether the slope of the curve has increased or decreased. Each time the slope of the curve has increased the comparator 38 is arranged to provide a low output signal and each time the slope of the curve has decreased, the comparator 38 is arranged to provide a high output signal. The high output signals indicating a slope decrease are fed to a counter 42 and the low output signals indicating slope increase are fed to a reset circuit 44 associated with the counter and arranged to clear the counter resetting it to zero.

At this point, it is noted that the counter 42 should receive no signals until the turn-on point A', illustrated in FIG. 1 of the drawing, has been reached in the tightening cycle. That is, to minimize the risk of premature shutoff of the wrench caused by irregularities in the pretightening region of the curve, the decision making function performed by the counter is delayed until it is assured that the fastener has been tightened to some point in the tightening region of the curve. To provide the delay, a comparator 46 receives the instantaneous torque signal from the strain gauge 25 and compares the instantaneous torque signal with a signal from a generally conventional signal generating device 48 which signal is representative of a predetermined torque value expected to be in the tightening region of the Torque-Rotation curve. For example, the torque value equal to about 30% of the torque normally expected at the yield point of the fastener being tightened will suffice. When the comparator 46 determines that the instantaneous torque signal exceeds the predetermined torque signal from the signal generator 48, it outputs an enabling signal to an AND gate 50 and to an exclusive OR gate 52. In the embodiment of the invention disclosed herein, comparator 46 is arranged to provide a high output signal when it determines tht the turn-on point A' has been achieved in the tightening cycle.

The output signal from the comparator 38 is also fed to the AND gate 50 so that after the turn-on point A' in the tightening cycle, a decrease in the slope of the curve causing the comparator 38 to provide a high output signal enables the AND gate to provide an output to the counter 42. The outputs from the AND gate 50 to the counter will successively transfer conducting states down the series of output circuits illustrated in the drawing to the output circuit connected to the solenoid valve 20. When the predetermined number of signals indicating the slope of the curve has decreased are counted, the counter 42 will provide an output signal to the solenoid valve 20 which will discontinue the operation of the wrench by closing that valve. The output signal from the comparator 38 is also fed to the exclusive OR gate 52 so that after the turn-on point A' in the tightening cycle, an increase in the slope of the curve causing the comparator 38 to provide a low output signal enables the OR gate to provide an output to the reset circuit 44 which, as noted previously, clears the counter 42 resetting it to zero. Accordingly, it should be understood that the counter 42 is responsive to indicating signals from the comparator 38 to count a predetermined successive number of times that the slope of the Torque-Rotation curve which could be plotted for the fastener being tightened has decreased and to provide a control signal to the solenoid valve 20 to discontinue the tightening of the fastener.

While in the foregoing there has been described a preferred embodiment of the invention, it should be understood to those skilled in the art that various modifications and changes can be made without departing from the true spirit and scope of the invention as recited in the claims.

I claim:

1. A tightening system for tightening an assembly including a fastener system until the yield point or some similarly significant point has been detected, said system comprising:

wrench means for applying tightening characteristics to the fastener;

first means associated with said wrench means for measuring a first tightening characteristic and developing a first signal representative thereof and second means associated with said wrench means for measuring a second tightening characteristic and developing a second signal representative thereof;

gradient calculating means responsive to said first and second signals for determining the instantaneous slope between predetermined increments of the second tightening characteristic of the curve of said first tightening characteristic vs. said second tightening characteristic which could be plotted for said tightening characteristics for the fastener being tightened and for developing a signal representative of each instantaneous slope;

first comparator means responsive to said instantaneous slope signals for determining the change between said instantaneous slope signals and for developing indicating signals indicative of an increase or decrease in the slope of the curve; and, control means responsive to said indicating signals for providing a control signal when the fastener has been tightened a predetermined measure of said second tightening characteristic from the increment of said second tightening characteristic at which the maximum slope of the curve has been experienced.

2. A tightening system in accordance with claim 1 wherein said control means provides said control signal when the slope of the curve has decreased continuously over said predetermined measure of said second tightening characteristic.

3. A tightening system in accordance with claim 2 wherein said first comparator means is operative at each increment of said second tightening characteristic to develop either a first signal indicating that the instantaneous slope signals are increasing or a second signal indicating that the instantaneous slope signals are decreasing.

4. A tightening system in accordance with claim 3 wherein said control means includes counter means for counting said second signals, said counter means being resettable to zero by said first signals whereby said control signal is developed when a predetermined number of successive ones of said second signals is counted.

5. A tightening system in accordance with claim 4 wherein said first tightening characteristic is the torque being applied to said fastener and said second tightening characteristic is the rotation of said fastener, said first means being a transducer for measuring the torque and said second means being an angular displacement probe for measuring predetermined increments of rotational displacement of said fastener.

6. A tightening system in accordance with claim 5 wherein said predetermined measure is a rotational displacement in a range of about 15° to 35°.

7. A tightening system in accordance with claim 5 wherein said predetermined measure is rotational displacement of about 25°.

8. A tightening system in accordance with claim 4 wherein said predetermined number of said second signals is equal to said predetermined measure of said second tightening characteristic divided by the interval between successive increments of said second tightening characteristic.

9. A tightening system in accordance with claim 1 including means responsive to said control signal for discontinuing the operation of said wrench means.

10. A method of tightening an assembly including a fastener system until the yield point or some similarly significant point has been detected, said method comprising:

applying tightening characteristics to the fastener;

measuring a first tightening characteristic and a second tightening characteristic during the tightening cycle;

determining the instantaneous slope between predetermined increments of the second tightening characteristic of the curve of said first tightening characteristic vs. said second tightening characteristic which could be plotted for said tightening characteristics for the fastener being tightened;

determining when the fastener has been tightened through a predetermined measure of said second tightening characteristic from the increment of said second tightening characteristic at which the maximum slope of the curve has been detected.

11. A method in accordance with claim 10 wherein the last mentioned determination is made at each increment of said second tightening characteristic by determining the change between successively determined instantaneous slopes and determining when the instantaneous slopes have decreased continuously over said predetermined measure.

12. A method in accordance with claim 11 wherein the determination that the instantaneous slopes have decreased continuously over said predetermined measure is made by determining when the slope has decreased a predetermined successive member of times.

13. A method in accordance with claim 12 wherein said first tightening characteristic is the torque applied to the fastener and wherein said second tightening characteristic is the rotational displacement of the fastener.

14. A method in accordance with claim 13 wherein said predetermined successive number of times is equal to the predetermined measure of rotation of the fastener divided by the interval between successive increments of rotation of the fastener.

15. A method in accordance with claim 11 wherein said first tightening characteristic is the torque applied to the fastener and wherein said second tightening characteristic is the rotational displacement of the fastener.

16. A method in accordance with claim 15 wherein said predetermined measure is a rotational displacement in a range of about 15° to 35°.

17. A method in accordance with claim 15 wherein said predetermined measure is a rotational displacement of about 25°.

18. A method in accordance with claim 10 wherein the application of tightening characteristics is discontinued when the fastener has been tightened through said predetermined measure.

* * * * *